US012601114B2

(12) United States Patent
Kurki

(10) Patent No.: US 12,601,114 B2
(45) Date of Patent: Apr. 14, 2026

(54) HIGH YIELD COOKING METHOD

(71) Applicant: AMPPC Finland Oy, Lappeenranta (FI)

(72) Inventor: Matti Kurki, Lappeenranta (FI)

(73) Assignee: AMPPC Finland Oy, Lappeenranta (FI)

( * ) Notice: Subject to any disclaimer, the term of this patent is extended or adjusted under 35 U.S.C. 154(b) by 263 days.

(21) Appl. No.: 18/004,190

(22) PCT Filed: Jun. 23, 2021

(86) PCT No.: PCT/FI2021/050481

§ 371 (c)(1),
(2) Date: Jan. 4, 2023

(87) PCT Pub. No.: WO2022/008791

PCT Pub. Date: Jan. 13, 2022

(65) Prior Publication Data

US 2023/0265611 A1 Aug. 24, 2023

(30) Foreign Application Priority Data

Jul. 6, 2020 (FI) ..... 20205725

(51) Int. Cl.

| | |
|---|---|
| ***D21C 11/00*** | (2006.01) |
| ***D21C 1/02*** | (2006.01) |
| ***D21C 3/06*** | (2006.01) |
| ***D21C 3/20*** | (2006.01) |
| ***D21C 3/22*** | (2006.01) |
| ***D21C 9/18*** | (2006.01) |

(52) U.S. Cl.
CPC ..... *D21C 11/0007* (2013.01); *D21C 1/02* (2013.01); *D21C 3/06* (2013.01); *D21C 3/20* (2013.01); *D21C 3/22* (2013.01); *D21C 3/222* (2013.01); *D21C 9/18* (2013.01)

(58) Field of Classification Search
CPC ... D21C 1/02; D21C 3/06; D21C 3/22; D21C 9/18; D21C 1/00
See application file for complete search history.

(56) References Cited

U.S. PATENT DOCUMENTS 4,294,653 A * 10/1981 Lindahl ..... D21B 1/12 162/28
4,486,267 A 12/1984 Prusas
(Continued)

FOREIGN PATENT DOCUMENTS

AU 2010202496 B2 4/2015
CA 2786949 A1 8/2011
(Continued)

OTHER PUBLICATIONS

Smook, Handbook for Pulp and Paper Technologists, 1992, Angus Wilde Publications, 2nd edition, chapter 6 (Year: 1992).*
(Continued)

*Primary Examiner* — Anthony Calandra
(74) *Attorney, Agent, or Firm* — Ziegler IP Law Group, LLC.

(57) ABSTRACT

A cooking method and a digester system wherein partly digested cellulosic fiber source is compressed during cooking to provide high molecular weight xylan, high molecular weight lignin and pulp.

13 Claims, 4 Drawing Sheets

(56) References Cited

U.S. PATENT DOCUMENTS

| | | | | |
|---|---|---|---|---|
| 4,552,616 | A * | 11/1985 | Kauppi | D21B 1/021 162/84 |
| 4,599,138 | A | 7/1986 | Lindahl | |
| 4,634,499 | A | 1/1987 | Ampulski | |
| 4,734,162 | A | 3/1988 | Ampulski | |
| 6,214,164 | B1 | 4/2001 | Rantala | |
| 6,668,600 | B1 * | 12/2003 | Hansson | D21C 9/18 68/43 |
| 2005/0203291 | A1 | 9/2005 | Svenson et al. | |
| 2011/0250638 | A1 * | 10/2011 | Sjoede | D21C 1/06 435/68.1 |
| 2018/0037863 | A1 * | 2/2018 | Foody | D21C 1/02 |

FOREIGN PATENT DOCUMENTS

| | | | |
|---|---|---|---|
| CN | 104379833 | A | 2/2015 |
| CN | 109196164 | A | 1/2019 |
| DE | 1517219 | A1 | 12/1969 |
| DE | 2628971 | A1 | 1/1978 |
| EP | 0287960 | B1 | 9/1994 |
| EP | 1375734 | A1 | 1/2004 |
| GB | 1136219 | A | 12/1968 |
| JP | 2014147313 | A | 8/2014 |
| WO | 0052256 | A1 | 9/2000 |
| WO | 2012007642 | A1 | 1/2012 |
| WO | 2012158075 | A1 | 11/2012 |
| WO | 2013044042 | A1 | 3/2013 |
| WO | 2015124498 | A1 | 8/2015 |
| WO | 2017203329 | A1 | 11/2017 |

OTHER PUBLICATIONS

Deutschle et al., Effects of cationic xylan from annual plants on the mechanicalproperties of paper, 2014, Carbohydrate Polymers, 102, p. 627-635 (Year: 2014).*

Li et al., The current and emerging sources of technical lignins and their applications, 2019, PMC. (Year: 2019).*

Sixta editor, Handbook of Pulp, 2006, Wiley, VCH, p. 366-559 (Year: 2006).*

Notification of Transmittal of the International Search Report and the Written Opinion of the International Searching Authority; European Patent Office; Application No. PCT/FI2021/050481; mailed Sep. 29, 2021; 15 pages.

Search Report; Finnish Patent and Registration Office; Application No. 20205725; mailed Feb. 4, 2021; 2 pages.

China Patent Office, Office Action pertaining to application 202180047567.2, Dated Mar. 14, 2024, 9 Pages.

* cited by examiner

HIGH YIELD COOKING METHOD

FIELD

The present disclosure relates to a cooking method for combined production of at least HMW lignin and pulp by sulfite or organic acids from wood based cellulosic raw material. The pulp produced according to the method is useful for manufacturing paper grade pulp, dissolving cellulose products and derivatives of cellulose.

BACKGROUND

Organic acid, sulfite pulp and dissolving pulp, also known as paper pulps or dissolving cellulose, is a bleached wood pulp that has a high cellulose content and is produced chemically from the wood by using a sulfite process or organic acid process. The sulfite processes are a commonly used pulping process and in a conventional sulfite process, wood is treated with an aqueous mixture of various salts of sulfurous acid to extract the lignin from wood chips The salts used in the pulping process are either sulfites ($SO_3^{2-}$), or bisulfites ($HSO_3^-$), depending on the pH. The counter ion can be sodium ($Na^+$), calcium ($Ca^{2+}$), potassium ($K^+$), magnesium ($Mg^{2+}$) or ammonium ($NH_4^+$). This treatment degrades and solubilizes lignin leading to a defibration of the wood fibers. Organic acid used in the pulping can be but not restricted to lactic acid, acetic acid, formic acid, citric acid, oxalic acid, uric acid and malic acid. An organic acid is an organic compound with acidic properties. The most common organic acids are the carboxylic acids, whose acidity is associated with their carboxyl group —COOH. Sulfonic acids, containing the group —$SO_2OH$, are relatively stronger acids. Alcohols, with —OH, can act as acids but they are usually very weak. The relative stability of the conjugate base of the acid determines its acidity. Other groups can also confer acidity, usually weakly: the thiol group-SH, the enol group, and the phenol group. In biological systems, organic compounds containing these groups are generally referred to as organic acids.

Generally wood pulp contains high levels of alpha cellulose, which is used in the manufacture of various cellulose derivatives for various end uses or products, is known in the art as dissolving pulp. Other terms synonymous with dissolving pulp are chemical cellulose and special high alpha pulp. Two processes are in general used for the manufacture of dissolving pulp viz:

1) The acid sulphite process, the development of which started at about the beginning of this century (Rydholm, S. A., Pulping Processes, p. 280, Interscience Publishers, New York-London-Sydney 1965); and
2) The prehydrolysis-Kraft process, the development of which started in 1929 (Rydholm referred to above-p 281)

The latter process makes use of an acidic pretreatment ("pre-hydrolysis") step in order to remove hemicellulose prior to the alkaline pulping (delignification) step. South African Patent 88/4037 discloses the pre-hydrolysis-neutral sulphite-anthraquinone process (PH-NS-AO) for the manufacture of "hemicellulose hydrolysate and special pulp" (high alpha grade). This pre-hydrolysis step performs essentially the same function as the pre-hydrolysis step prior to the Kraft (Sulphate) pulping method for the manufacture of dissolving grade pulp; while the neutral sulphite-anthraquinone delignification step is essentially the same as the process also known as the semi-alkaline sulphite-anthraquinone (SAS-AQ) process, first reported at a technical conference in 1979 by Raubenheimer, S and Eggers, S. H., (both being research workers employed by SAPPI LIMITED, the present applicant herein) viz the 11th European ESPRA Meeting, Maastricht, The Netherlands, during May 1979.

Furthermore, conventional manufacturing of paper and dissolving pulps by sulfite processes suffer from low yields as the hemicelluloses and cellulose in the wood are degraded during the process, as low-molecular weight hemicellulose, monosaccharides and hemicellulose degradation products. The sulfite processes suffer from high cooking time and therefore the hemicelluloses and celluloses in the wood are degraded. Due to difficulties in extracting these degradation products from the digester, the degraded material is at best used for energy production by evaporation and burning of the components or else simply discarded as waste.

A summary of the development of acidic sulfite pulping processes for preparing semichemical pulps is found in R. Runkel and K. F. Patt, "Halbzellstoffe" (Semichemical Pulps), Günther-Stalb Verlag, Biberach 1958, pages 35-37 and pages 95-96. The production of high-yield chemical pulps, semichemical pulps and chemi-mechanical pulps according to the sulfite process is also described in "S. A. Rydholm, Pulping Processes, Interscience Publishers, New York, London, Sydney, 1965, pages 418-420".

In addition, G. Jayme, L. Broschinksi, W. Matzke (in Das Papier 18, 1964, pages 308 through 314) present a general survey of high-yield chemical pulps and give a detailed description of rapid pulping in the vapor phase with magnesium bisulfite at a maximum temperature of 180° C. over a period of 8 to 20 minutes.

DE-A-1-517219 relates to the preparation of a (high-yield) sulfite chemical pulp. Wood raw material is pulped with an aqueous solution containing sulfite and/or bisulfite ions as well as sodium, potassium, magnesium, or ammonium ions. The pH of the solutions at onset of pulping is 3.0 to 7.0, preferably 3.7 to 5.0. The maximum pulping temperature is 140° to 190° C. The entire pulping process takes more than 400 minutes. The residence time at the maximum temperature is 30 to 200 minutes. Pulping is carried out at a chlorine number of the finished chemical pulp in the range of 15 to 32, the pulped material then being subjected to controlled defibration and/or defibration/refinement. After that, fines are removed in an amount of 0.2 to 7% of the amount of the chemical pulp. In unbeaten form (freeness value ° SR=14.5-15) the material thus obtained has a breaking length of 6.3 km. The chemical pulp is not bleached.

U.S. Pat. Nos.4,634,499 and 4,734,162 each relate to processes for preparing a chemical pulp from hardwood which is especially suitable for the preparation of tissue papers. Pulping is carried out with ammonium sulfite, first at less than 110° C., then at a maximum temperature of 140° C. to 155° C. at a pH of about 2 to 3. The chemical pulp is not subjected to an additional bleaching step.

EP 0 287 960 A relates to a process for preparing a hemicellulose hydrolysate and a special chemical pulp by a two-step process, wherein a first step comprises pre-hydrolysis of the ligno-cellulosic materials, for example, with water, a mineral acid, sulfur dioxide, sulfite pulping liquor, and sulfite waste liquor, at a temperature of 100° C. to 180° C. and over a hydrolysis period of 10 to 200 minutes, and a second step in which the lignin contained in the pre-hydrolysed material is dissolved occurs by means of neutral sulfite pulping with addition of anthraquinone as the catalyst, the initial pH being at least 10. The temperature is preferably 160° C. to 180° C. and the treatment time 100 to 200 minutes.

Accordingly, the aspects of the disclosed embodiments are directed to provide an improved industrial scale cooking process for producing high yield paper grade and dissolving pulp with low hemicellulose content and which can be easily delignified and bleached to required brightness and viscosity level.

Another aspect of the disclosed embodiments is to provide a cooking system for wood-based cellulosic raw material which provides pulp, xylan and lignin with high productivity.

SUMMARY

At least some of the above and other aspects of the disclosed embodiments may be obtained by the subject matter as defined in the independent claims. Additional advantages may be obtained when using the embodiments described in the dependent claims and below. The aspects of the disclosed embodiments are advantageous in that it makes possible to generate value-added products, such as at least one of HMW hemicellulose, HMW xylan and HMW lignin, from wood based cellulosic material used in pulping. Further, the aspects of the disclosed embodiments use less energy in production of dissolving pulp or paper grade pulp than conventional pulping processes.

The aspects of the disclosed embodiments also allows decreasing processing/cooking time. A further advantage is that the total yield of paper and dissolving pulp is higher in the present processes than what can be achieved using conventional sulfite process when producing paper or dissolving grade pulps.

The sulfite cooking liquors can be various salts of sulfurous acid. The cooking liquor is used to extract the lignin from the wood-based cellulosic raw material, such as wood chips. The salts used in sulfite cooking liquor are either sulfites ($SO_3^{2-}$) or bisulfites ($HSO^{3-}$), depending on the pH. The counter ion can be for example sodium (Na+), calcium ($Ca^{2+}$), potassium ($K^+$), magnesium ($Mg^{2+}$) or ammonium ($NH_4^+$) or their combination.

According to a first aspect is provided a cooking method comprising:

a) providing wood based cellulosic raw material comprising chips, pin chips, shavings, saw dust, or a combination thereof;
b) optionally pre-treating the wood based cellulosic raw material by steaming at 80-120° C. to provide pre-treated material comprising cellulosic solid fraction;
c) optionally pre-hydrolyzing the wood based cellulosic raw material and/or the pre-treated material with steam or water to provide pre-hydrolyzed material;
d) d) cooking in cooking conditions comprising a cooking liquor comprising a chemical charge selected from the range between 1-200 g/l of acidic sulfite or an organic acid selected from lactic acid, acetic acid, formic acid, citric acid, oxalic acid, uric acid and malic acid, to provide cooked cellulosic material in a spent liquor;
e) grinding and compressing the cooked cellulosic material in the cooking conditions to release HMW lignin from the cooked material into the spent cooking liquor, and to provide a compressed cellulose fraction;
f) recovering the HMW lignin from the spent cooking liquor;
g) displacing the spent cooking liquor with a displacing liquor containing cooking liquor having 1-200 g/l of sulfite or organic acid;
h) recovering the HMW lignin from the displacing liquor; and
i) recovering pulp from the compressed cellulose fraction.

According to a second aspect is provided a HMW xylan fraction obtainable by using the present method.

The present method provides xylan with higher molecular weight, higher xylan yield and higher xylan concentration in the HMW xylan fraction.

According to a third aspect is provided a HMW lignin fraction obtainable by using the present method.

With the present methods a HMW lignin fraction can be obtained with a better lignin yield and higher consistency. The HMW lignin also has increased molecular weight compared to the one produced according to prior processes, such as the one disclosed in PCT/FI2011/050651.

According to a fourth aspect is provided pulp obtainable by using the present method, such as dissolving pulp and/or paper grade pulp. The obtained pulps according the present method have higher brightness, and require less wet pressing and lower steam consumption in drying compared to pulps produced according conventional methods. The dissolving pulps have additionally lower hemicellulose content compared to conventionally produced pulps.

Embodiments of the present disclosure provide certain benefits. Depending on the embodiment, one or several of the following benefits may be achieved: decreased consumption of chemicals, water, cellulosic fiber source, and energy; improved yield of cellulose, increased molecular weight of xylan and lignin.

DETAILED DESCRIPTION

Figure 1:
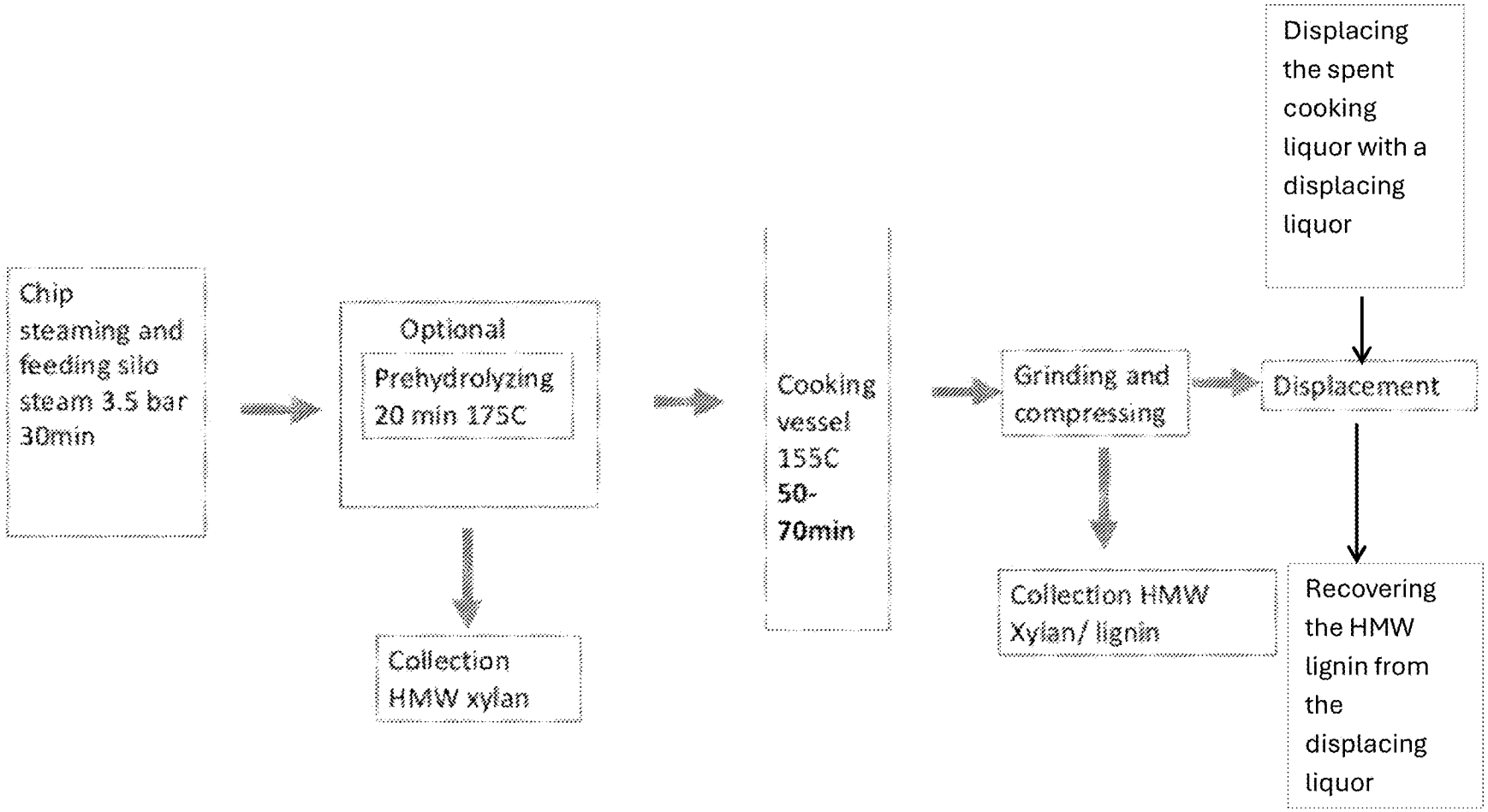
FIG. 1 schematically illustrates an embodiment of the present method involving optional pre-steaming and optional pre-hydrolyzing of the wood based cellulosic raw material, and a digester system for grinding and/or compressing condensate liquors out of wood chips after cooking. The process parameters mentioned in FIG. 1 are exemplary only, and other process parameters can be used, as described in this disclosure.
Figure 2:
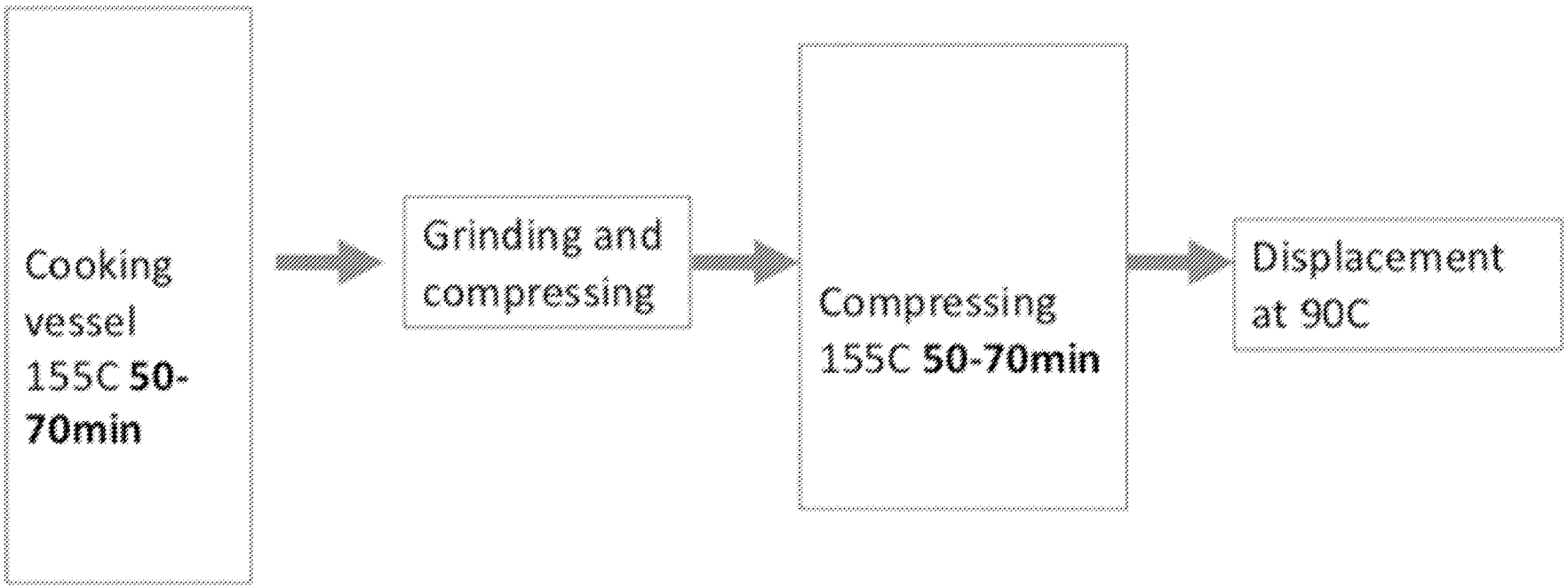
FIG. 2 schematically illustrates an embodiment of a digester system for compressing cooking liquors out of wood chips when using organic acid or sulphite cooking. The process parameters mentioned in FIG. 2 are exemplary only, and other process parameters can be used, as described in this disclosure.
Figure 3:
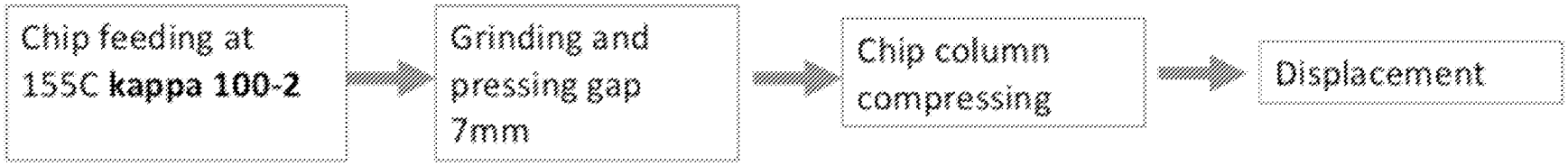
FIG. 3 illustrates an embodiment of a schematic process to compress the wood chips to press out the cooking liquors. The process parameters mentioned in FIG. 3 are exemplary only, and other process parameters can be used, as described in this disclosure.
Figure 4:
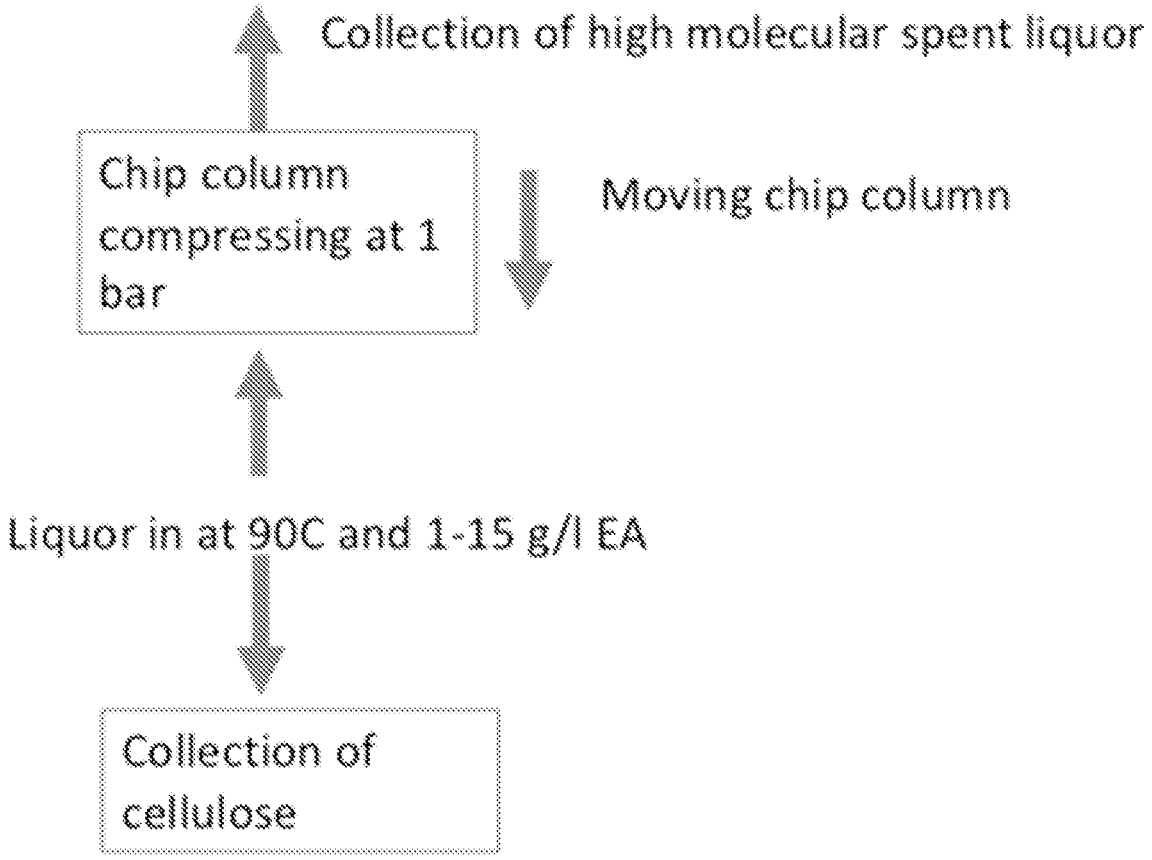
FIG. 4 schematically represents an embodiment of a displacing process for spent liquors from compressed wood chips. The process parameters mentioned in FIG. 4 are exemplary only, and other process parameters can be used, as described in this disclosure.

As used herein, the term "comprising" includes the broader meanings of "including", "containing", and "comprehending", as well as the narrower expressions "consisting of" and "consisting only of".

In an embodiment the process steps are carried out in the sequence identified in any aspect, embodiment or claim. In another embodiment any process step specified to be carried out to a product or intermediate obtained in a preceding process step is carried out directly to said product, i.e.

without additional, optional or auxiliary processing steps that may chemically or physically alter the product between said two steps.

In an embodiment the wood based cellulosic raw material used in the present cooking method is in the form of chips, pin chips, shavings, saw dust or any combination thereof. Preferably wood chips are used, more preferably softwood or hardwood chips, such as chips of *eucalyptus*, pine or spruce. However, when using wood chips as the primary raw material, the raw material may contain smaller amount of e.g. pin chips and/or saw dust.

Unless otherwise indicated, all percentage values refer to dry weight-% expressed as wt-%.

The present process is suitable for use in a plant or a mill, i.e. in industrial (large) scale processes.

In an embodiment the wood based cellulosic raw material has a xylan content of 4 weight-% or more. In an embodiment the wood based cellulosic raw material comprises wood chips.

The term high molecular weight xylan (HMW xylan) means xylan, which has an average weight molecular weight (Mw) of 45 000 g/mol or more.

The term high molecular weight lignin (HMW lignin) means lignin which has an average weight molecular weight (Mw) of 4500 g/mol or more for hardwood and for softwood 4980 g/mol or more.

In an embodiment molecular weight is measured by Size-Exclusion Chromatography and is presented as average weight molecular weight (MW).

Wood chips typically have a generally rectangular shape with a height, length, and width. However, the geometry of a wood chip may vary depending e.g. on its manufacturing process. The length (longest dimension) and width (second longest dimension) of a chip can be considered to determine the general "flat side" of a chip, and the thickness is the smallest dimension of the chip. For pin chips the width and thickness can be close to each other, thereby forming a match-like elongated object. The exact dimensions of the chip may vary.

In an embodiment the cellulosic raw material serving as a fiber source of the wood based cellulosic raw material comprises or consists of wood chips, and the grinding and compressing is applied to the largest area of surface of the wood chip. Preferably the grinding and compressing is carried out to achieve a density between 250-2000 kg/m$^3$, preferably between 350-1525 kg/m$^3$, to release at least HMW xylan and/or HMW lignin. Grinding and compressing to the largest area of surface can be achieved by using a gap which allows the chips to enter their smallest dimension, or "a side" first. Equipment used for this purpose can be between segmented plates, feeding screws with blades with decreasing distance, plug feeding screws feeding against rotating segment plates, rotors and stators with segmented plates, modified pump where the stator and the rotor of the pump have segmented plates enabling pressing and feeding action, drum presses with gap and segmented surfaces, modified stator and rotor systems. The solutions are not limited to above mentioned and can be applied by person skilled in the art.

In an embodiment the wood-based cellulosic raw material is pre-treated by steaming before cooking and/or before pre-hydrolyzation.

According to an embodiment the pre-treatment by steaming is preferably carried out to achieve air evacuation of the air inside the wood chips in order to improve liquor penetration to the porous wood material. Pre-steaming can be carried out in separate steaming vessel or in chips silo. In an embodiment the steaming is carried out by using low pressure steam with an approximate pressure of 3.5 bar for at least 10 min, preferably more than 20 min. In an embodiment pre-steaming comprises pre-steaming with low pressure steam at 1-4 bar for 1-100 min to provide pre-treated material. In an embodiment the temperature is more than 100° C., preferably more than 120° C.

After the optional pre-treatment, the raw material can be taken to the optional pre-hydrolyzing step or directly to the cooking step.

In an embodiment the optionally pre-treated wood-based cellulosic raw material is pre-hydrolyzed before cooking.

In an embodiment the pre-hydrolysis is carried out by steam or water at a temperature selected from the range 150-220° C. In an embodiment the pre-hydrolyzing step comprises pre-hydrolyzing with steam at 8-15 bar at a temperature selected from the range 150-220° C. for 1 to 150 min.

In an embodiment the grinding and compressing step is carried out by a plug feeding screw in a separate screw, with segmented plates, or the material is pressed through a rotating gap. The gap allows the chip to enter so that the shortest dimension enters first, however without being limited to these embodiments.

In a preferable embodiment the chips are forced to enter the gap such that their flat side with the largest surface area does not enter the gap first. This can be achieved by directing the chip to a gap to which the chip does not fit its flat side ahead.

In an embodiment grinding and compressing is carried out by taking the material through the gap in the cooking conditions to release HMW lignin into the spent cooking liquor, thereby providing HMW lignin in spent cooking liquor.

In an embodiment the grinding and compressing is carried out to consistency of more than 10 wt-%, preferably more than 20% or more preferably more than 30%, preferably more than 65%. Consistency can be measured using standard TAPPI T 240 Consistency (Concentration) of Pulp Suspensions or corresponding ISO 4119 standard.

In an embodiment the grinding and compressing is carried out at the cooking temperature and to a consistency of at least 10 wt-%.

In an embodiment the grinding and compressing is carried out by taking the wood chips through a gap in the range 50 mm-8 mm, so that wood porosity decreases inside the gap at least 20%, 30%, 40%, 50%, 60%, 70% or more, and at least HMW lignin is released.

In an embodiment the grinding and compressing is carried out by taking the pin chips through a gap in the range 35 mm-6 mm, so that wood porosity decreases inside the gap at least 20%, 30%, 40%, 50%, 60%, 70% or more, and at least HMW lignin is released.

In an embodiment the grinding and compressing is carried out by taking the saw dust through a gap in the range 20 mm-4 mm, so that wood porosity decreases inside the gap at least 20%, 30%, 40%, 50% 60%, 70% or more, and at least HMW lignin is released.

Ina an embodiment the grinding and compressing is carried out by pressing the optionally pre-hydrolyzed material and/or the cooked cellulosic material through a gap, and a size of the gap is selected such that:

- for wood chips the gap is selected from the range 50 mm-8 mm,
- for pin chips the gap is selected from the range 35 mm-6 mm, and for saw dust the gap is selected from the range 20 mm-4 mm.

The wood material porosity is calculated by 1-amount wood inside the gap ($kg/m^3$)/1500 $kg/m^3$.

Grinding and compressing to the largest area of surface can be achieved by using a gap which allows the chips to enter their smallest dimension first. Equipment used for this purpose can be segmented plates, screws, modified pumps, drum presses, modified screws, modified stator and rotor systems.

According to an embodiment the cooking liquor comprises sulfite acids (acidic sulfite) or organic acids.

In an embodiment the cooking method is a sulfite pulping process. Chemicals in a cooking liquor of the sulfite pulping process are either sulfites ($SO_3^{2-}$), or bisulfites ($HSO^{3-}$), depending on the pH. The counter ion can be sodium ($Na^+$), calcium ($Ca^{2+}$), potassium ($K^+$), magnesium ($Mg^{2+}$) or ammonium ($NH_4^+$).

In an embodiment the cooking liquor contains organic acids selected from lactic acid, acetic acid, formic acid, citric acid, oxalic acid, uric acid and malic acid. An organic acid is an organic compound with acidic properties.

In an embodiment the cooking liquor has a chemical charge selected from the range 1-200 g/l, preferably 1-100 g/l, of organic acid, or sulfite, or bisulfite, or an organic acid selected from lactic acid, acetic acid, formic acid, citric acid, oxalic acid, uric acid and malic acid.

In an embodiment the spent cooking liquor comprises spent sulfite liquor.

In an embodiment the spent cooking liquor comprises spent organic acid liquor.

In an embodiment the cooking is carried out at a temperature of at least 120° C., preferably more than 150° C., more preferably more than 170° C.

In an embodiment the wood based cellulosic raw material has an alfa cellulose content of more than 60 wt-%, preferably more than 70 wt-%, and more preferably more than 80 wt-% calculated from dry material.

The cooking time at cooking temperature is between 0-500 min, preferably between 0-20. Short cooking times can be achieved when the desired kappa number is reached soon, even immediately after pre-hydrolysis, depending e.g. on the raw material, pre-treatment and pre-hydrolysis.

In an embodiment the ratio of the cooking liquor to the wood based cellulosic raw material is selected from 2-10 as dry mass of the wood based cellulosic material.

In an embodiment the grinding and compressing releases at least one of xylan and lignin into the cooking liquor, thereby forming spent cooking liquor containing at least one of HMW lignin and HMW xylan, and a solid fraction comprising compressed material. The HMW xylan can be recovered from the spent liquor. The HMW lignin can be recovered from the spent liquor.

In an embodiment grinding and compressing is started before the wood chip has reached a porosity level of 0.35-0.9, preferably 0.35-0.85.

In an embodiment during grinding and compressing the wood based cellulosic raw material particles, such as wood chips, are directed through a gap to which e.g. the chip fits only on its flat side. In an embodiment this treatment results into a consistency of more than 10%, preferably more than 20%, more preferably more than 30%, and even more preferably more than 65%.

In an embodiment the grinding and compressing is carried out by taking the wood chips through a gap in the range 50 mm-8 mm, so that wood porosity decreases inside the gap at least 20%, 30%, 40%, 50%, 60%, 70% or more. The increased porosity and pressure releases HMW lignin.

In an embodiment the grinding and compressing is carried out by taking the pin chips through a gap in the range 35 mm-6 mm, so that wood porosity decreases inside the gap at least 20%, 30%, 40%, 50%, 60%, 70% or more. The increased porosity and pressure releases HMW lignin.

In an embodiment the grinding and compressing is carried out by taking the saw dust through a gap in the range 20 mm-4 mm, so that wood porosity decreases inside the gap at least 20%, 30%, 40%, 50% 60%, 70% or more. The increased porosity and pressure releases HMW lignin.

In an embodiment the grinding and compressing is carried out by pressing the cooked cellulosic material through a gap, and a size of the gap is selected such that:

for wood chips the gap is selected from the range 50 mm-8 mm, for pin chips the gap is selected from the range 35 mm-6 mm, and for saw dust the gap is selected from the range 20 mm-4 mm.

The wood material porosity is calculated by 1-amount wood inside the gap ($kg/m^3$)/1500 $kg/m^3$.

The term black liquor in the present invention means used cooking liquor, i.e. spent cooking liquor, or spent liquor.

In an embodiment the recovered HMW lignin has an average weight molecular weight (MW) more than 4500 g/mol when using hardwood raw material, and more than 4580 g/mol when using softwood raw material.

In an embodiment the compressed cellulose fraction has an alpha cellulose content of more than 65%, preferably more than 85%, more preferably more than 90%, and even more preferably more than 95%.

In an embodiment the cooked material is compressed in the spent liquor with a pressure selected from the range between 1 and 250 kPa to form a column of solids having a consistency of at least 5% by weight. After compressing the spent cooking liquor is displaced with a displacing liquor having a lignin content lower than in the black liquor.

Non-limiting examples of suitable pressures to reach the selected target consistency value are 1 kPa, 2 kPa, 3 kPa, 4 kPa, 5 kPa, 6 kPa, 7 kPa, 8 kPa, 9 kPa, 10 kPa, 20 kPa, 30 kPa, 40 kPa, 50 kPa, 60 kPa, 70 kPa, 80 kPa, 90 kPa, 100 kPa, 110 kPa, 120 kPa, 130 kPa, 140 kPa, 150 kPa, 160 kPa, 170 kPa, 180 kPa, 190 kPa, 200 kPa, 210 kPa, 220 kPa, 230 kPa, 240 kPa, and 250 kPa. Non-limiting examples of suitable consistency values are 5%, 6%, 7%, 8%, 9%, 10%, 15%, 20%, 25%, 30%, 35%, 40%, 45% and 50% by weight based on dry matter.

The compressed column of the material at the end of step e) can be diluted to a consistency selected from the range between 2 and 35% by weight, such as 2%, 3%, 4%, 5%, 6%, 7%, 8%, 9%, 10%, 15%, 20%, 25%, 30%, or 35% by weight based on dry matter.

In the embodiment a HMW lignin fraction and/or a HMW xylan fraction is recovered from the spent cooking liquor. Optionally a lignin and/or xylan containing smaller molecular weight species is also recovered.

In an embodiment the dissolving pulp is dewatered to remove 90% lignin and dissolved xylan and other organic and inorganic material as a liquor flow from the pulp and to provide dewatered pulp.

In the embodiment in the step e) the compressive pressure is selected from the range between 35 kPa and 1000 kPa.

In the embodiment the compressing is carried out to a density selected from the range between 350 kg/m3 and 2000 $kg/m^3$, preferably between 350 kg/m3 and 1525 $kg/m^3$.

In the embodiment step e) is carried out to increase porosity of the fiber cell wall. In the embodiment the step e) comprises pressing with a pressure selected from the range between 1 kPa and 250 kPa to form a column having a consistency of at least 5% by weight.

In the embodiment the displacement liquor has a chemical charge selected from the range between 1-200 g/l organic acid or acid sulfite cooking liquor, preferably 1-100 g/l. In the embodiment the displacing is carried out at a temperature selected from the range between 70° C. and 200° C.

In the embodiment after step i) the pulp is dewatered to remove 90% or more of the sulfite, alkali, lignin and dissolved xylan and other organic and inorganic material as a liquor flow from the pulp, and to provide dewatered pulp.

In the embodiment the method comprises delignifying the dewatered pulp by oxygen to provide delignified pulp, optionally followed by washing and pressing.

In the embodiment the temperature and alkali or acid sulfite cooking liquor charges are not changed between cooking and grinding compressing steps.

In an embodiment the method comprises the pre-hydolyzing step and wherein the grinding and compressing is carried out at the pre-hydrolyzing temperature, and to a consistency of at least 10% by weight.

In an embodiment the method comprises the pre-hydrolyzing step, and wherein grinding and compressing is carried out to a consistency of at least 60% by weight.

In an embodiment the method comprises the pre-hydrolyzing step, and cooking is continued to a kappa number selected from the range between 100 and 3, at a cooking temperature selected from the range between 12° and 180° C.

In an embodiment the method comprises the pre-hydrolyzing step, and pre-hydrolyzed material and/or the cooked cellulosic material is treated by grinding and compressing preferably by pressing through a gap, and a size of the gap is selected such that:

- for wood chips the gap is selected from the range 50 mm-8 mm,
- for pin chips the gap is selected from the range 35 mm-6 mm, and
- for saw dust the gap is selected from the range 20 mm-4 mm.

In an embodiment the grinding and compressing is carried out at the cooking temperature, and to a consistency of at least 10% by weight.

In an embodiment in the step e) the compressive pressure is selected from the range between 35 kPa and 1000 kPa.

In an embodiment the compressing is carried out to a density selected from the range between 350 kg/m3 and 2000 kg/m$^3$, preferably between 350 kg/m3 and 1525 kg/m$^3$. In an embodiment the method the step e) is carried out to increase porosity of the fiber cell wall.

In an embodiment the step e) comprises pressing with a pressure selected from the range between 1 kPa and 250 kPa to form a column having a consistency of at least 5% by weight.

In an embodiment the displacing is carried out at a temperature selected from the range between 70° C. and 200° C.

In an embodiment after step i) the pulp is dewatered to remove 90% or more of the sulfite, alkali, lignin and dissolved xylan and other organic and inorganic material as a liquor flow from the pulp, and to provide dewatered pulp.

In an embodiment the method comprises delignifying the dewatered pulp by oxygen to provide delignified pulp, optionally followed by washing and pressing.

EXAMPLES

The effects obtainable by embodiments of the method of invention are demonstrated by the following experiments, which should not be considered as limiting the scope of the invention. The abbreviation REF refers to prior art methods, i.e. cooking method without compressing step according to the present invention. The cooking conditions can be selected by the person skilled in the art to get the target kappa number at the end of the cooking stage.

Example 1

In this example *eucalyptus* wood pulps were produced both according to the present invention and according to a reference method (REF), by cooking at 165° C. *eucalyptus* acidic cooking liquor ($MgSO_3$) with total $SO_2$ 7.8% and active MgO 0.71%. The wood chips were first impregnated at 9 bar by increasing temperature from 50° C. to 110° C. in 90 minutes at liquor to wood ratio of 5. After that in cooking phase liquor to wood ratio was decreased to 3.8 and cooking temperature 151° C. was reached after 2 hours and 10 min. At the end of cooking according to invention chips were fed through narrow gap causing pressing and shearing and the HWM-lignin containing spent liquor was displaced with washing filtrate.

In this example pine wood pulps were also produced both according to the present invention and reference method (REF). The sulphite cooking was carried out using magnesium sulphite cooking. The active MgO amount was 2% and the total $SO_2$ was 7% and pH was 4%. The wood chips were first impregnated at 9 bar by increasing temperature from 50° C. to 110° C. in 90 minutes at liquor to wood ratio of 5. After that in cooking phase liquor to wood ratio was decreased to 3.8 and cooking temperature 160° C. was reached after 80 min. After cooking according to the invention the obtained chips were fed through a narrow gap causing pressing and shearing and the HWM-lignin containing spend liquor was displaced with washing filtrate.

The cooking results are presented the table 1 for sulphite cooking.

TABLE 1

| Sample | Kappa number | Cooking time decrease, min | Cooking, yield | Lignin, average MW, g/mol |
|---|---|---|---|---|
| REF sulphite Eucalyptus | 9.5 | — | 40.5 | 2300 |
| REF sulphite Pine | 25 | — | 49.2 | 4500 |
| Sulphite Eucalyptus | 10.2 | 47 | 41.7 | 6450 |
| Sulphite Pine | 26 | 40 | 51.3 | 6800 |

According to table 1 lignin weight average Mw molecular weight and cooking yield increases, and cooking time decreases to target kappa number when cooking is done according to the present invention. The cooking plant capacity increase because of the cooking time decrease.

In the table 2 are presented the increase in the pulp amount to the same drainage time.

TABLE 2

| Pulp charge to the same drainage time. | |
|---|---|
| Sample | |
| REF sulphite Eucalyptus | 1000 g/m2 |
| REF sulphite Pine | 1000 g/m2 |

TABLE 2-continued

| Pulp charge to the same drainage time. | |
|---|---|
| Sample | |
| Sulphite Eucalyptus | 1550 g/m2 |
| Sulphite Pine | 1750 g/m2 |

As the results confirm, the present method improves also pulp drainage and therefore increase pulp mill fiber line production capacity.

The foregoing description has provided, by way of non-limiting examples of particular implementations and embodiments of the invention, a full and informative description of the best mode presently contemplated by the inventor for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A cooking method comprising:

a) providing wood based cellulosic raw material comprising chips, pin chips, shavings, saw dust, or a combination thereof, and a pre-treating the wood based cellulosic raw material by steaming at 80-120° C. to provide pre-treated material comprising cellulosic solid fraction to form a pre-treated wood based cellulosic material;

b) cooking the pre-treated wood based cellulosic material in cooking conditions comprising a cooking liquor comprising a chemical charge selected from the range between 1-200 g/l of acidic sulfite as total $SO_2$ or an organic acid selected from lactic acid, acetic acid, formic acid, citric acid, oxalic acid, uric acid and malic acid, to provide cooked cellulosic material in a spent cooking liquor;

c) grinding and compressing the cooked cellulosic material in the cooking conditions to release high molecular weight lignin (HMW lignin) from the cooked material into the spent cooking liquor, and to provide a compressed cellulose fraction;

d) recovering the HMW lignin from the spent cooking liquor;

e) displacing the spent cooking liquor with a displacing liquor containing cooking liquor having 1-200 g/l of acid sulfite as total $SO_2$ or organic acid;

f) recovering the HMW lignin from a displaced liquor; and g) recovering pulp from the compressed cellulose fraction; and wherein step c) is carried out at a temperature of 120-180° C. and to a consistency of at least 10% by weight.

2. The method of claim 1 wherein the method comprises a pre-hydrolyzing step comprising pre-hydrolyzing the pre-treated material with steam or water to provide pre-hydrolyzed material; and wherein the grinding and compressing is carried out at the pre-hydrolyzing temperature, and to a consistency of at least 10% by weight.

3. The method of claim 2, wherein grinding and compressing is carried out to a consistency of at least 60% by weight.

4. The method of claim 2, wherein cooking is continued to a kappa number selected from the range between 100 and 3.

5. The method of claim 2 wherein the grinding and compressing is carried out by grinding and compressing through a gap, and a size of the gap is selected such that:

for wood chips the gap is selected from the range 50 mm-8 mm, for pin chips the gap is selected from the range 35 mm-6 mm, and for saw dust the gap is selected from the range 20 mm-4 mm.

6. The method of claim 1, wherein in the step c) the compressive pressure is selected from the range between 35 kPa and 1000 kPa.

7. The method of claim 1, wherein the compressing is carried out to a density selected from the range between 350 kg/m3 and 2000 kg/$m^3$.

8. The method of claim 1, wherein the step c) is carried out to increase porosity of the fiber cell wall.

9. The method of claim 1, wherein the step c) comprises pressing with a pressure selected from the range between 1 kPa and 250 kPa to form a column having a consistency of at least 5% by weight.

10. The method of claim 1, wherein the displacing is carried out at a temperature selected from the range between 70° C. and 200° C.

11. The method of claim 1, wherein the chemical charge is acidic sulfite and after step i) the pulp is dewatered to remove 90% or more of the sulfite, lignin and dissolved xylan and other organic and inorganic material as a liquor flow from the pulp, and to provide dewatered pulp.

12. The method of claim 11 comprising delignifying the dewatered pulp by oxygen to provide delignified pulp, optionally followed by washing and pressing.

13. The method of claim 1, wherein the temperature and cooking liquor chemical charges are not changed between cooking and grinding compressing steps.

* * * * *